United States Patent [19]

Biffle

[11] Patent Number: 4,783,084

[45] Date of Patent: Nov. 8, 1988

[54] HEAD FOR A ROTATING BLOWOUT PREVENTOR

[76] Inventor: Morris S. Biffle, 2609 Country Club Dr., Midland, Tex. 79701

[21] Appl. No.: 887,537

[22] Filed: Jul. 21, 1986

[51] Int. Cl.[4] ..... E21B 33/03

[52] U.S. Cl. ..... 277/9; 166/82; 166/85; 175/195; 251/1.2; 277/31

[58] Field of Search ..... 277/9, 31; 251/1.2; 166/82–85; 285/272, 276; 175/195, 209

[56] References Cited

U.S. PATENT DOCUMENTS

| | | | |
|---|---|---|---|
| 3,868,832 | 3/1975 | Biffle | 166/82 V |
| 3,934,887 | 1/1976 | Biffle | 277/31 |
| 4,143,880 | 3/1979 | Bunting et al. | 277/31 |
| 4,154,448 | 5/1979 | Biffle | 277/31 |
| 4,208,056 | 6/1980 | Biffle | 277/31 |
| 4,361,185 | 11/1982 | Biffle | 166/84 |
| 4,363,357 | 12/1982 | Hunter | 166/84 |
| 4,423,776 | 1/1984 | Wagoner et al. | 166/84 |
| 4,526,243 | 7/1985 | Young | 277/31 X |

*Primary Examiner*—Allan N. Shoap
*Attorney, Agent, or Firm*—Marcus L. Bates

[57] ABSTRACT

A rotating blowout preventor is comprised of a rotating head assembly which is removably received at the upper end of a main housing. The rotating parts of the head assembly are held fastened together by the provision of a unique locking plate arrangement. An internal bearing chamber is formed within the head assembly and is protected from contamination by an unobvious arrangement of the coacting parts which form the rotating head. The head assembly can rapidly be disassembled without the use of special tools, thereby making field repair of the apparatus possible. The main housing has a replaceable washpipe and seat that likewise is easily field replaceable.

12 Claims, 3 Drawing Sheets

HEAD FOR A ROTATING BLOWOUT PREVENTOR

BACKGROUND OF THE INVENTION

In the drilling of boreholes, it is often necessary to include a rotating blowout preventor at the upper end of the surface casing. The rotating blowout preventor sealingly receives the kelley in a slidable manner axially therethrough so that the kelley can support and drive the drill string while at the same time fluid can be conveyed through the drill string, downhole to the drill bit, back up through the borehole annulus, where the fluid is discharged from an outlet located at the rotating blowout preventor. In the event a payzone is encountered, the rotating blowout preventor restrains the increased pressures and maintains the flow from the borehole under control, precluding the occurrence of a "blowout".

In the drilling of deep boreholes, it is not unusual for the rotating blowout preventor to fail because one of the many coacting parts thereof has broken or has become unduly worn, as for example, the bearings, a seal, or the stripper rubber. In fact, it is not unusual for the stripper rubber of the rotating blowout preventor to require replacement several times during the drilling of a deep borehole. It would therefore be advantageous to be able to provide a rotating blowout preventor fabricated in such a manner that the various parts thereof, including the stripper rubber, could easily be replaced in the field without the necessity of special tools.

Reference is made to my previous U.S. Pat. Nos. 4,208,056 issued June 17, 1980, and 4,154,448 issued May 15, 1979 for further background of this invention.

SUMMARY OF THE INVENTION

A rotating blowout preventor has a lower main support body adapted to be connected to the upper end of a wellhead or stack, and an upper part in the form of a rotating head assembly which is removably received in supported, sealed relationship to the upper end of the main support body. The rotating head assembly has a fixed support member, the lower end of which is removably connected to the main support body. A rotatable rubber support is of cylindrical configuration and has plate members at opposed ends thereof. The lower plate member removably receives a stripper rubber in mounted relationship thereon while the upper plate member forms the upper terminal end of the rotating head assembly.

A cylindrical skirt member is arranged in spaced, concentric relationship respective to the medial part of the rubber support. A plurality of spaced, circumferentially extending locking plates form the outermost rotating wall surface of the head assembly and connect the outer peripheral edge of the upper plate member to the skirt member.

A bearing housing is formed within the area defined by the main support body, cylindrical skirt member, and an upper closure member. Spaced bearing contained within the bearing housing transfer the load from the stripper rubber, through the rubber support, into the outer cylindrical skirt member, where relative rotation is effected between the fixed main support body and the stripper rubber by the bearing means.

A special clamp assembly cooperates with the head assembly and main body to enable the assembly to be removably mounted together in a manner that enables the rotating head assembly to be easily removed from the lower part thereof.

The lower part of the rotating blowout preventor has a seat and washpipe removably mounted at the upper end thereof which can easily be replaced in the field.

Accordingly, a primary object of this invention is the provision of improvements in a rotating blowout preventor which provides a new and unobvious apparatus having the parts thereof assembled and protected in a manner which avoids contamination of the moving parts thereof.

Another object of this invention is the provision of an improved rotating blowout preventor having a rotating head assembly which can be easily disassembled in the field so that worn parts thereof can be replaced with new parts without the necessity of employing special tools and craftsmen.

Still another object of this invention is the provision of a rotating blowout preventor having a unique rotating head assembly at the upper end thereof which is removably seated on the upper end of a lower main body member so that the rotating blowout preventor can rapidly be subdivided into its major components.

A still further object of this invention is the provision of a rotating blowout preventor having an upper rotating head assembly which is removably clamped to the upper end of a main support body, and wherein the main support body has a seat and washpipe removably affixed thereto.

These and other objects of the present invention are achieved when one skilled in the art fabricates various different rotating blowout preventors in accordance with the teachings set forth in the present disclosure.

DETAILED DESCRIPTION OF THE PREFERRED EMBODIMENT

Figure 1:
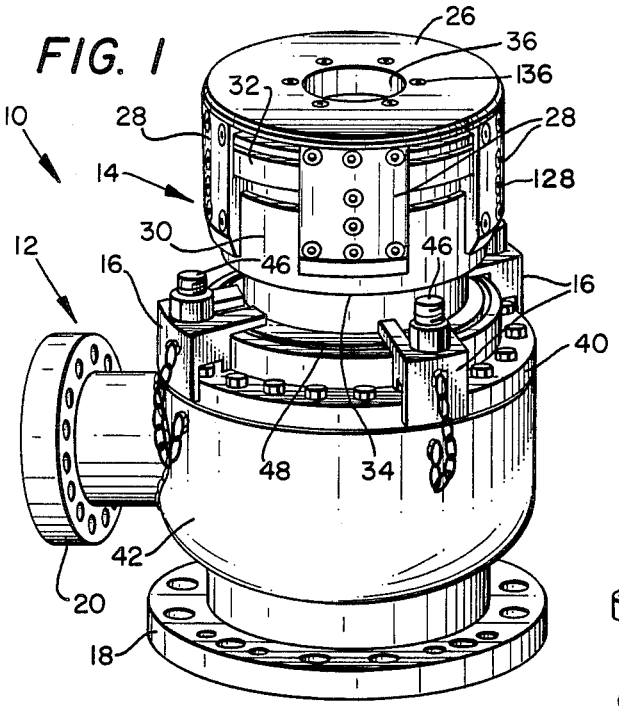
FIG. 1 is a perspective view of a rotating blowout preventor made in accordance with the present invention.

FIG. 1 discloses a rotating blowout preventor 10, made in accordance with the present invention, and hereinafter referred to as "RBOP". The RBOP 10 of this invention includes a lower main housing 12, the details of which are more fully disclosed in FIG. 2, and a rotating head assembly 14, the details of which are more fully disclosed in FIGS. 3 and 5.

Figure 2:
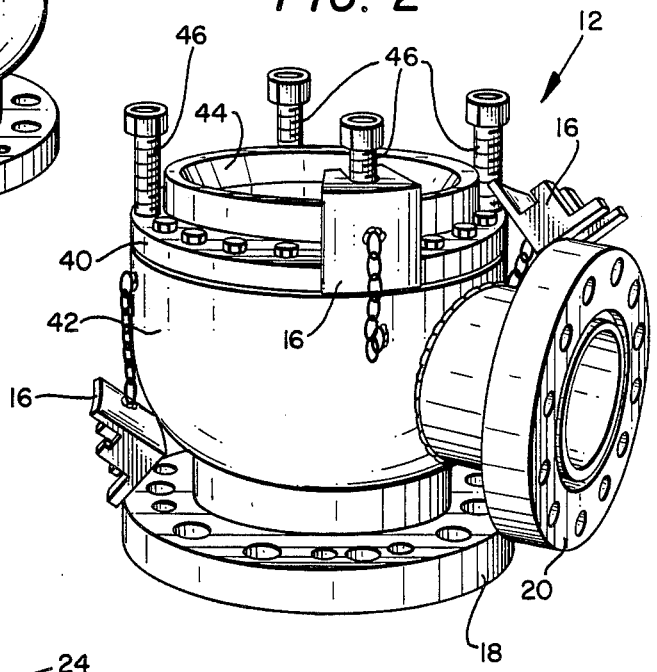
FIG. 2 is a perspective view showing the side opposite of part of the apparatus disclosed in FIG. 1.

As illustrated in FIGS. 1 and 2, a plurality of radially spaced clamps 16 removably affix the rotating head assembly 14 to the main housing 12. The main housing 12 includes a casing flange 18 by which the RBOP is connected to the top of a stack, or to the top of a wellhead. Outlet 20 conducts flow of returned drilling mud to the mud pit or the like, in the usual manner.

Figure 3:
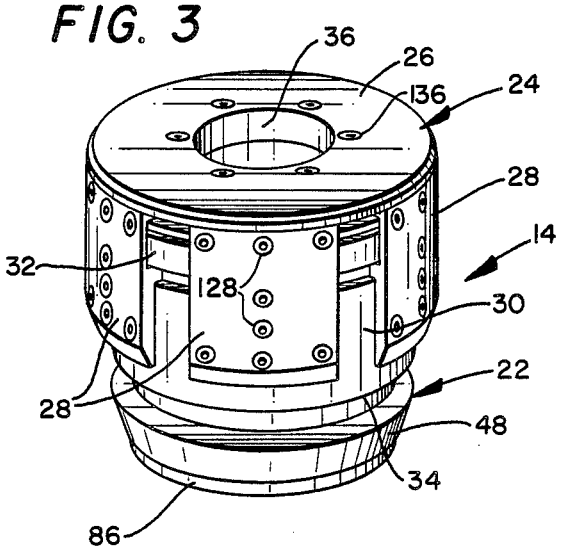
FIG. 3 is a perspective view illustrating another part of the apparatus disclosed in FIG. 1.

In FIG. 3, together with other figures of the drawings, it will be noted that the rotating head assembly 14 includes a fixed main support body 22 by which the lower marginal end of the head is removably seated within the upper interior marginal end of the main housing. Numeral 24 broadly indicates the rotating parts of the rotating head assembly 14. Upper plate member 26 defines the upper terminal end of the RBOP 10.

A plurality of circumferentially extending locking plates 28 are spaced from one another and are located at the outermost radial distance from the axis of the rotating head 14. The locking plates 28 lock various rotating components of the head assembly to one another, as will be more fully appreciated later on as this disclosure is more fully digested.

A skirt 30 is fastened to the upper plate member 26 by the locking plates 28 and therefore rotate with the locking plates 28, the upper plate member, and with a kelley or the like that may be used to drive the RBOP.

Figure 4:
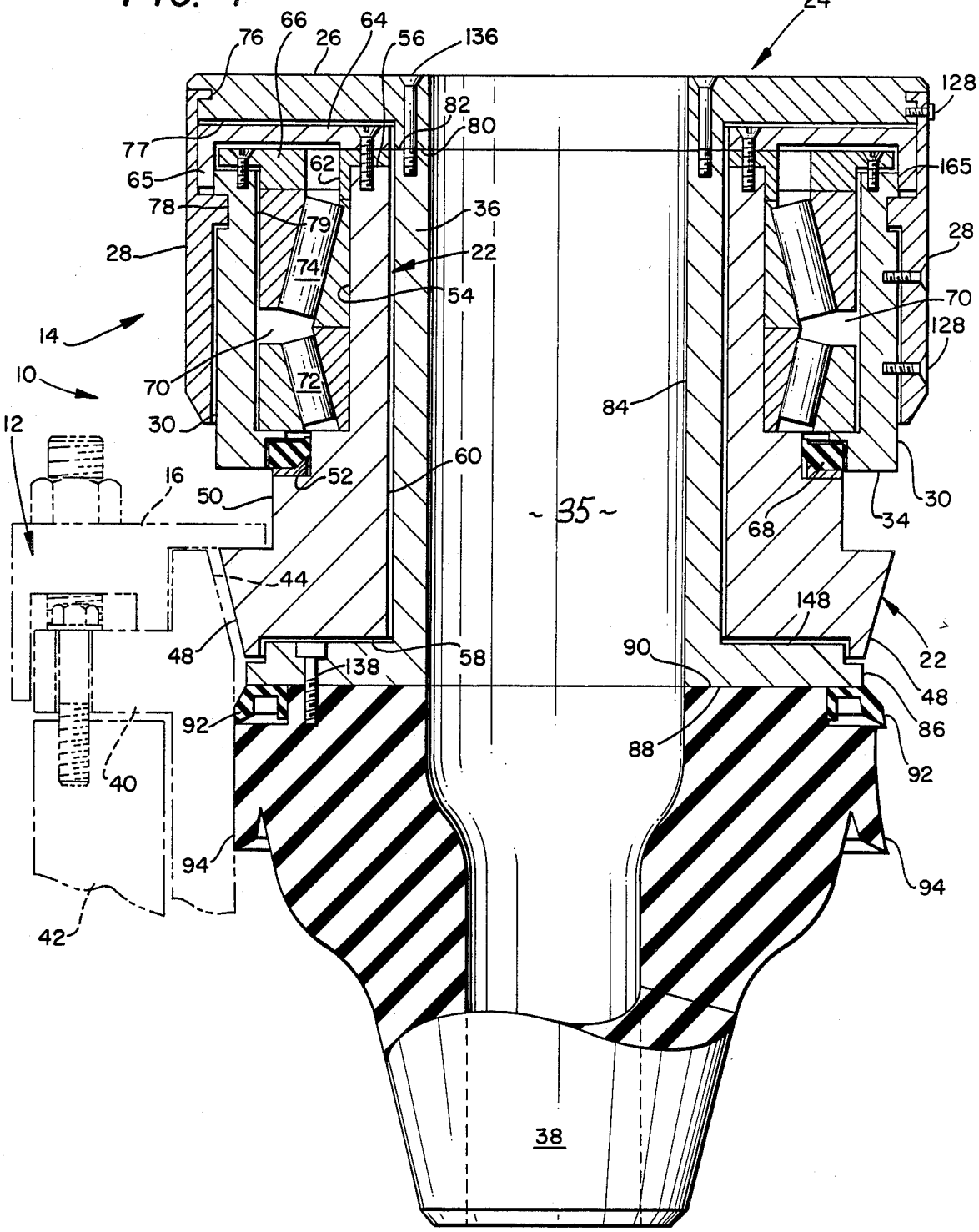
FIG. 4 is an enlarged, longitudinal, cross-sectional view of the apparatus disclosed in FIG. 3; and, FIG. 5 is an exploded view of the apparatus disclosed in FIG. 3.

Numeral 32 indicates an upper closure member associated with a bearing housing. The closure member 32 is fixed to the main support body 22. Numeral 34 indicates the lower circumferentially extending edge of the rotating skirt 30. The head assembly 14 includes a longitudinal axial passageway 35 defined by a rubber support 36. The axial passageway 35 extends through the entire rotating head assembly and through a stripper rubber 38, as seen in FIG. 4. The stripper rubber 38 is not shown attached to the rotating head in FIG. 3.

In FIG. 4, like or similar numerals refer to like or similar parts wherever it is possible or logical to do so. As seen in FIG. 4, the rubber stripper assembly 38, preferably of unitary construction, is attached in aligned relationship to the before mentioned rotating head assembly and forms one of the rotating parts thereof.

Figure 5:
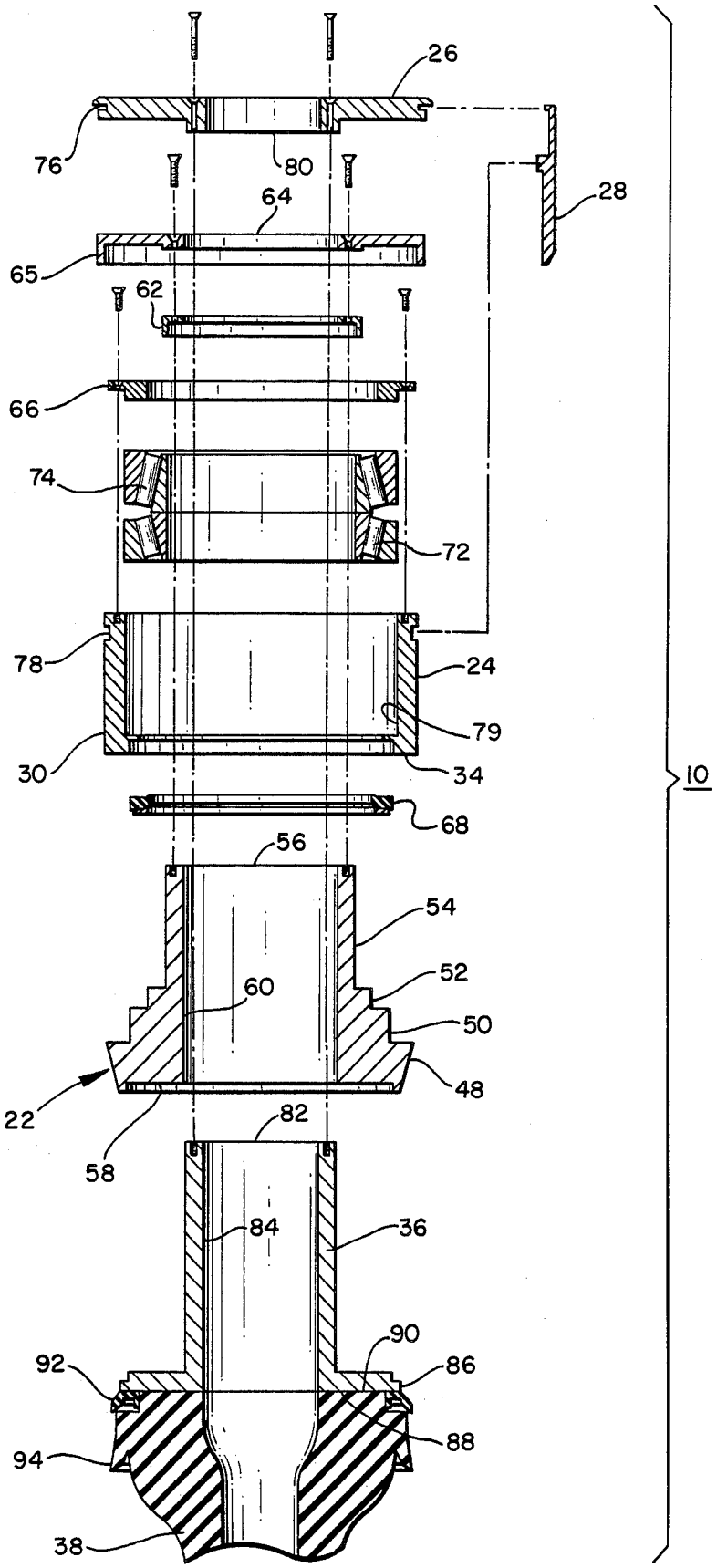

As seen in FIGS. 2, 4, and 5, a removable seat and washpipe of unitary construction are made integrally with flange 40 and are affixed to the main support housing 42. The seat comprises a beveled inside surface 44 for receiving a complementary beveled lower end 48 of the fixed main support body 22. Bolts extend through the removable seat flange for removably affixing the seat and washpipe to the support housing 42. In FIGS. 1 and 4, bolts 46 are anchored to the flange 40 and have a generous portion thereof extending above the upper surface of the flange for removably receiving the clamps 16 in operative relationship therewith.

The fixed main support body 22 has a beveled seat 48 formed circumferentially about the lower outer surface thereof which is received in seated relationship within the before mentioned coacting beveled inside surface 44 formed at the upper inner end of the housing 42.

In FIGS. 4 and 5, numeral 50 indicates a reduced diameter medial length of the main support body 22 which forms a horizontal circumferentially extending shoulder at the lower end thereof, against which the illustrated lugs or protrusions of the clamps 16 are received. Reduced diameter part 52 of fixed support body 22 provides an annular sealing shoulder for sealingly engaging the rotating seal means 68. Upwardly extending reduced diameter cylindrical wall 54 forms a circumferentially extending bearing housing interior wall surface, which terminates at the upper end 56 of the main support body 22. Upper terminal end 56 is opposed to lower end 58 thereof. Numeral 60 indicates the inside diameter of the main support body 22 within which the before mentioned rubber support 36 is rotatably received.

A cone hold down 62 is received in sandwiched relationship between the upper end 56 of the main support body 22 and the upper bearing chamber closure 32. The bearing chamber closure member 32 includes a horizontal part 64 from which a skirt 65 depends downwardly. The horizontal part 64 is fastened to the cone hold down 62 and the upper end 56 of the main support body 22 by the illustrated threaded fastener. The closure member 32 is fixed to the main support body and the skirt 65 thereof slidably encloses the upper marginal end of the skirt 30. Hence, the lower marginal end of skirt lip 65 terminates in overlapping relationship respective to the upper marginal end of the rotating skirt 30. A bearing adjusting ring 66 is fastened to the rotating skirt and bears against the outer race or cone of the upper bearing assembly 74. Grease seal 68 is affixed to the rotating skirt 30 and seals against the reduced diameter part 52 of member 22.

Bearing chamber 70 is therefore formed between the exterior fixed wall surface 54 of the main support body 22, the interior wall surface of the fixed bearing chamber closure member 32, 64 and 65, and the interior wall surface of the rotating skirt member 30. The bearing chamber has a metal to metal seal 165 formed between the overlapping skirt members 65 and 30, and a commercially available seal 68 between members 52 and 34. The dual bearing assembly contained within the bearing housing includes an upper bearing 74 and a lower bearing 72. The bearing assembly includes inner cones affixed to the reduced diameter part 54 and outer cones or races which are affixed to and rotate with the skirt 30.

A circumferentially extending groove 76 is formed within the upper plate member 26. Circumferentially extending groove 78 is formed within the upper marginal end of the skirt member 30. The grooves are spaced vertically from one another and receives the inwardly directed dogs of the locking plates 28 in close tolerance relationship therewithin. Bolts 128 secure the plates 28 to the rotating skirt and to the upper plate member. Numeral 79 indicates the inside peripheral wall surface of skirt 30.

Bottom edge 82 of upper plate member 26 is affixed to the upper terminal end 82 of the rubber support 36, and transfer of torque therebetween is achieved by means of the illustrated fasteners. Numeral 84 indicates the interior sidewall of the rubber support 36 which is also the before mentioned axial passageway 35. Flange 86 has the illustrated step formed therein made complementary respective to the step that forms the lower terminal end of the main support body 22 and thereby isolates the interface 148 formed between the rotating and non-rotating parts from one another, and further forms a "slinger ring" which maintains the interface free of debris.

The upper face 90 of the stripper rubber 38 is vulcanized to the lower face 88 of the rubber support 36. The flange 86 preferably is bolted at 138 to a complementary flange attached to the rubber 30 in the manner set forth in my previous U.S. Pat. Nos. 4,154,448, 4,208,056 and 4,441,551.

Rotating seal 92 is commercially available and is positioned to sealingly engage the interior surface of the illustrated washpipe and prevent flow thereacross. A debris seal 94 also sealingly engages the interior of the washpipe and prevents debris from entering the interface between the rotating rubber and the interior of the washpipe.

The apparatus seen in FIG. 3 can be hoisted into axially aligned relationship respective to the apparatus seen in FIG. 2, and set down to cause the seating surfaces 48 and 44 to be mated with one another in the illustrated manner of FIGS. 1 and 4. Next, the clamp members 16 are assembled in the illustrated manner of FIGS. 1 and 4 to thereby maintain the RBOP in assembled relationship.

In operation, the returned mud is contained within and flows up the well annulus and exhausts through outlet 20 of the RBOP so long as seals 92 and 94 are in good repair. In order for contamination to occur from the returned mud, flow must be effected across seals 92 and 94, and then the contaminant must somehow work its way up the annulus formed between the rotating parts 24 and the non-rotating parts 22 which is highly unlikely to happen. That is, in order for contaminants to injure the critical bearing chamber, it would be necessary that the contaminants work up the interface 148 seen near numeral 58 of FIG. 4, up the vertical annulus seen near numeral 60, and outwardly through the annulus seen near numeral 64, and then back through the annulus seen near numeral 66. In this event, the debris would be thrown by centrifugal, force in an outward direction at both the horizontal annulus at 148, 64, and again at 66. Any debris that may collect near the outer surface between the innerface of 64 and 77 is continually wiped or cut off from the assembly by the rotating locking plates 28.

Hence, the present RBOP teaches a novel bearing chamber which cannot be contaminated by returned mud, regardless of the condition of the rubber stripper seals 92 and 94.

Failure of the grease seal 68 will permit lubricant to exit the bearing chamber, and lack of lubricant will eventually lead to increased wear at the bearings; however, this condition should be noted by an alert driller and remedial steps taken before the bearings are damaged.

It is novel to provide a bearing chamber which is isolated from the drilling mud in the manner of the present invention. It is novel to utilize clamps 16 for holding a main support body 22 seated within a main support housing 42; and to provide a combination washpipe and hold down 40 which can be replaced respective to the main support housing 42 in the manner of the present invention.

The combination represented by the present invention provides a RBOP having an unexpectedly long life and which can be easily disassembled and field repaired, thereby greatly increasing the utility of the RBOP while at the same time significantly reducing the cost of operation thereof.

I claim:

1. A rotating blowout preventor having a lower main housing which can be attached to a wellhead, and an upper rotating head assembly romovably received in supported relationship respective to said main housing, said rotating head assembly has a fixed main support body and a rotatable rubber support, a stripper rubber removably mounted at the lower end of the rubber support;

means forming a bearing chamber, journal means enclosed within the chamber by which the rotatable rubber support is rotatably mounted respective to the main support body;

said rubber support includes a cylindrical member received within the main support body; a rubber mount at one end and an upper plate member at the other of said cylindrical member means mounting said stripper rubber to said rubber mount; a cylindrical rotating skirt member concentrically arranged in spaced relationship respective to said main support body;

said main support body and said cylindrical rotating skirt member, respectively, form spaced inner and outer walls, respectively, of said bearing chamber; an annular plate member is affixed to and radiates from the upper end of said main support body and forms an upper closure member for the bearing chamber;

seal means between the lower end of the cylindrical rotating skirt member and the fixed support, seal means between the upper end of the cylindrical rotating skirt member and the outer end of the closure member, and a plurality of locking plates spaced from one another and removably affixing the cylindrical rotating skirt member to the upper plate member;

whereby the stripper rubber and rubber support of the rotating head assembly can be removed from the fixed support by removing the locking plates and upper plate member from the rotating head assembly, after the rotating head assembly has been removed from said lower main housing.

2. The rotating blowout preventor of claim 1 wherein said lower main housing has a conical seat formed at the upper and thereof, a washpipe extending from said conical seat, a bolt flange made integral respective to said seat and washpipe by which the seat and washpipe can be replaced respective to the remainder of said main housing.

3. The rotating blowout preventor of claim 1 wherein said seal means between the lower end of the cylindrical skirt member and the fixed support is a down-turned, circumferential lip formed about the periphery of said annular plate member, said lip has an inner peripheral surface which slidably engages the upper outer marginal end of said cylindrical skirt member.

4. The rotating blowout preventor of claim 1 wherein said lower main housing has a conical seat formed at the upper end thereof, a washpipe extending from said conical seat, a bolt flange made integral respective to said seat and washpipe by which the seat and washpipe can be replaced;

wherein said seal means between the cylindrical skirt member and the fixed support is a circumferential lip formed about the periphery of said annular plate member, said lip has an inner peripheral wall surface that slidably engages an upper outer marginal end of said cylindrical skirt member.

5. In a rotating blowout preventor of the type that has a lower part in the form of a main support housing which can be attached to a wellhead, and an upper rotating head assembly that is removably received in supported relationship respective to the upper end of said main support housing, with there being an axial passageway formed through the main support housing and through the rotating head assembly through which a rotating member, such as a kelly, can slidably extend; said rotating head assembly includes an annular fixed main support member having an annular rotatable rubber support received therewithin; a stripper rubber removably mounted at the lower end of the rubber support for receiving a driving member in slidable and sealed relationship therethrough; the improvement comprising:

means forming an external bearing chamber within said rotating head assembly, journal means supported within said bearing chamber by which the rubber support is rotatably mounted respective to the fixed main support member;

said rubber support is a cylindrical member received within the fixed support member; a rubber mount at one end and an upper plate member at the other end of said cylindrical support member by which a load can be transferred; a rotatable cylindrical skirt member concentrically arranged in spaced relationship respective to said rubber support and to said fixed main support member;

said main fixed support member and said rotatable cylindrical skirt member form concentric, spaced, inner walls of said bearing chamber and rotate respective to one another; an annular upper plate member radiates from the upper end of the main fixed support and forms a fixed, upper closure member that defines the upper end of the bearing chamber;

seal means positioned between the lower end of the cylindrical rotatable skirt member and the fixed main support member, seal means formed between the upper end of the cylindrical rotatable skirt member and the upper outer end of the fixed closure member;

a plurality of locking plates circumferentially spaced from one another and removably affixing the rotatable cylindrical skirt member to the upper plate member;

whereby both said seal means are associated with said bearing chamber and by their location prevent returned drilling mud from entering said bearing chamber.

6. The improvement of claim 1 wherein said lower part has a conical seat formed at the upper end thereof, a washpipe extending from said conical seat, a bolt flange made integral respective to said seat and washpipe by which the seat and washpipe can be replaced respective to said lower part.

7. The improvement of claim 5 wherein said seal means between the upper end of the cylindrical skirt member and the main fixed support member is a downturned, circumferential lip formed about the outer periphery of said annular upper plate member, said lip has an inner peripheral surface which slidably engages the upper outer marginal end of said cylindrical skirt member.

8. The improvement of claim 5 wherein said lower part has a washpipe formed at the upper end thereof, a conical seat formed at the upper end of said washpipe, a bolt flange made integral respective to said seat and washpipe by which the seat and washpipe can be replaced on the lower part;

said seal means located between the upper end of the rotating skirt and the fixed main support is a circumferential extending lip defining the outer periphery of said annular upper plate member, said lip has an inner peripheral surface which slidably engages the upper outer marginal end of said cylindrical skirt member and thereby forms a seal means.

9. In a rotating blowout preventor having an longitudinal axial passageway formed therethrough for receiving a drilling member, a lower part which can be attached to a wellhead, and an upper part removably received in supported relationship respective to said lower part, said upper part is in the form of a rotating head assembly having a fixed main support body and a rotatable rubber support; a stripper rubber removably mounted at the lower end of the rubber support, so that a driving member can be axially received through the upper part, through the lower part, and through the stripper rubber of the upper part; the improvement comprising:

said rotating head assembly includes an external bearing chamber having journal means mounted therein by which the rotatable rubber support is rotatably mounted respective to the fixed main support body;

said rotatable rubber support includes a cylindrical member having a lower end, an outwardly directed member affixed to the lower end of said cylindrical member for mounting said stripper rubber to said rubber support, said cylindrical member is rotatably received within the fixed main support body;

an upper plate member that forms a load transfer member at the upper end of said cylindrical member; a rotatable cylindrical skirt member is concentrically arranged in spaced relationship respective to said fixed main support body;

said fixed main support body and said rotatable cylindrical skirt member form spaced walls with said bearing chamber being contained therebetween; an annular plate member radiates from the upper end of the fixed main support body and forms an upper closure member for the bearing chamber;

seal means positioned between the lower end of the rotatable skirt member and the outer periphery of the fixed main support body, seal means formed between the upper end of the rotatable skirt member and the outer end of the closure member; and, a plurality of locking plates circumferentially spaced from one another and removably affixing the cylindrical rotatable skirt member to the load transfer member;

whereby the rotating head assembly can receive a driving member therethrough and the rotating parts thereof are maintained free of debris.

10. The improvement of claim 9 wherein said upper part has a washpipe removably affixed at the upper end thereof a conical seat formed at the upper end of said washpipe, a bolt flange made integral respective to said seat and washpipe by which the seat and washpipe can be replaced respective to the main housing.

11. The improvement of claim 9 wherein said seal means located between the upper end of the rotatable skirt member and the fixed main support is a downturned, circumferential lip formed about the periphery of said upper plate member, said lip has an inner peripheral surface which slidably engages an upper outer marginal end of said rotatable skirt member.

12. The improvement of claim 9 wherein said lower part has a conical seat formed at the upper end thereof, a washpipe extending downwardly from said conical seat, a bolt flange made integral respective to said seat and washpipe by which the seat and washpipe can be replaced on the lower part;

wherein said seal means between the upper end of the rotatable skirt member and the fixed main support is a down-turned circumferential lip formed about the periphery of said upper plate member, said lip has an inner peripheral surface which slidably engages the upper outer marginal end of the said rotatable skirt member.

* * * * *

UNITED STATES PATENT AND TRADEMARK OFFICE

CERTIFICATE OF CORRECTION

PATENT NO. :4,783,084

DATED :NOVEMBER 8, 1988

INVENTOR(S) :MORRIS S. BIFFLE

It is certified that error appears in the above-identified patent and that said Letters Patent is hereby corrected as shown below:

Column 4, line 38, substitute --80-- for "82";

Column 5, line 19, delete the comma after "centrifugal";

Line 53, correct the spelling of "removably";

Column 7, line 33, substitute --Claim 5-- for "Claim 1";

Column 7, Line 61, substitute --a-- for "an";

Column 8, line 43, insert a comma after "thereof".

Signed and Sealed this

Twenty-third Day of May, 1989

*Attest:*

DONALD J. QUIGG

*Attesting Officer*

*Commissioner of Patents and Trademarks*